US005364250A

United States Patent [19]

Aoki et al.

[11] Patent Number: 5,364,250

[45] Date of Patent: Nov. 15, 1994

[54] OIL-FREE SCREW COMPRESSOR AND METHOD OF MANUFACTURE

[75] Inventors: Masakazu Aoki, Shimizu; Tatsuo Natori, Kashiwa; Hidetomo Mori, Ibaraki, all of Japan

[73] Assignee: Hitachi, Ltd., Tokyo, Japan

[21] Appl. No.: 120,521

[22] Filed: Sep. 14, 1993

[30] Foreign Application Priority Data

Sep. 18, 1992 [JP] Japan ..... 4-249828

[51] Int. Cl.[5] ..... F01C 1/16; B05D 1/18

[52] U.S. Cl. ..... 418/201.1; 418/178; 418/179; 427/438; 29/889.23; 29/889.71

[58] Field of Search ..... 418/178, 179, 201.1; 427/438; 29/889.7, 889.71, 889.23

[56] References Cited

U.S. PATENT DOCUMENTS

| | | | |
|---|---|---|---|
| 4,466,785 | 8/1984 | Biswas | 418/178 |
| 4,666,786 | 5/1987 | Yano et al. | 427/438 |
| 5,060,531 | 10/1991 | Iguchi et al. | 418/178 |

FOREIGN PATENT DOCUMENTS

| | | | |
|---|---|---|---|
| 0201072 | 8/1990 | Japan | 418/178 |
| 2243189 | 10/1991 | United Kingdom | 418/178 |

*Primary Examiner*—Richard A. Bertsch

*Assistant Examiner*—Charles G. Freay

*Attorney, Agent, or Firm*—Antonelli, Terry, Stout & Kraus

[57] ABSTRACT

A method of producing an oil-free screw compressor has the following steps: preparing a semi-finished metallic female rotor which has a spiral profile, and a semi-finished metallic male rotor which has a spiral profile; forming a metallic coating film containing particles of grinding material on the surface of the semi-finished female rotor; forming, on the surface of the semi-finished male rotor, a coating film of a material softer than the metallic coating film on the female rotor; grinding the surfaces of the semi-finished rotors into predetermined configurations; mounting the ground rotors on bearings so that the rotors are assembled in a rotor casing with a substantially constant spacing held between the axes of the semi-finished rotors; mounting timing gears on the rotors so as to drivingly connect the rotors each other; and driving the rotors by driving means while restraining the back lash in the rotating direction by means of the timing gears and applying a compression load to the rotors so that the coating film on the female rotor grinds and generates the coating film on the surface of the male rotor, thereby completing profiling of the male rotor and establishing a desired minimum gap between both rotors.

15 Claims, 3 Drawing Sheets

OIL-FREE SCREW COMPRESSOR AND METHOD OF MANUFACTURE

BACKGROUND OF THE INVENTION

1. Field of the Invention

The present invention relates to a method of producing an oil-free screw compressor and, more particularly, to a method of producing an oil-free screw compressor in which the gap between meshing rotors is minimized to improve the compression performance. The invention also relates to the compressor thus manufactured.

2. Description of the Prior Art

An oil-free screw compressor employs a pair of screw rotors which mesh with each other without any lubricating oil existing therebetween. Therefore, a gas under pressure or after compression tends to leak back to the suction side of the compressor through a gap between the meshing rotors, a gap between the rotors and the rotor casing wall and a gap between the discharge side end surfaces of the rotors and the discharge side end cover. Such leakage of the gas to the suction side adversely affects the performance of the screw compressor. In particular, leakage through the gap between the rotors is most critical because this gap forms a seal line between the compression chamber and the suction chamber. Namely, when large pressure differential exists between the suction and discharge chambers across the seal line, the compressed gas flows from the discharge chamber back to the suction chamber at a high rate, thus significantly affecting the performance of the compressor.

Meanwhile, there is a current trend towards reduction in machine size also in the field of oil-free screw compressors. Screw compressors of smaller sizes naturally provide smaller air discharge rate than screw compressors of larger sizes. Nevertheless, the leak of the gas inside the screw compressor is not reduced in proportion to the reduction in the air discharge rate. Attempts therefore have been made to minimize the gap between the rotors so as to reduce the reverse flow of the high-pressure gas from the discharge side to the suction side of the compressor.

Single-stage oil-free screw compressors are broadly used for compressing gases from atmospheric pressure to 7 ata or so. In such compressors, the compressed gas exhibits a high temperature well exceeding 300° C., so that the lobe portions of the rotors are thermally expanded and deformed by the heat of the compressed gas. It is therefore necessary that the profiles of the lobe portions of the rotors be designed in full consideration of the thermal expansions of the rotors.

To cope with such a demand, a method of producing a compressor is disclosed in, for example, Japanese Patent Examined Publication No. 61-47992. In this method, as shown in FIG. 5 which corresponds to FIG. 12 of the above-mentioned Japanese patent publication, a profile of a pair of rotors which mesh with each other at normal temperature are used as a basic rotor profile. Then, a first rotor profile is determined for one of the rotors which is assumed here to be a male rotor, taking into account the thermal expansion which is predicted to occur when this rotor is heated to a predetermined maximum credible temperature. Then, a second rotor profile is determined for the male rotor taking into account the back lash between the pair of rotors and an ideal gap size which would not cause the meshing rotors to contact with each other during operation. Then, a third rotor profile is determined for the rotor meshing with the male rotor, i.e., a female rotor. The third rotor profile is a profile which is generated based on the second rotor profile and which is to be assumed by the female rotor when the latter is deformed by thermal expansion. Then, a fourth rotor profile is determined for the female rotor. This fourth rotor profile is a profile to be exhibited by the female rotor when the female rotor, which assumes the third rotor profile in expanded state, is contracted by being cooled down to normal temperature. Finally, the rotors are fabricated at normal temperature based upon the fourth rotor profile for the female rotor and the basic rotor profile for the male rotor.

In oil-free screw compressors, the rotors rotate at very high speeds, e.g., 60 to 100 m/s in terms of the peripheral velocity. Therefore, any inadequate design value based upon prediction may lead to a serious accident such as breakdown of the rotors due to interference between the rotors. Damaging of the rotors may occur also when the compressor operates at a temperature which falls out of the range of given specifications. For instance, if the suction pressure is decreased down below a predetermined set pressure while the discharge pressure is elevated to exceed a set pressure, the compression ratio exceeds the set value so that the compressed gas such as air exhibits a temperature higher than the design temperature. In such a case, the rotors are expanded beyond limits to interfere with each other and thus are damaged. Besides the predicted temperature rise of the rotor as described, the following factors affect the size of the gap between the rotors:

(1) Each rotor exhibits a temperature distribution also in each cross-sectional plane perpendicular to the rotor axis. It is very difficult to exactly predict the amount of the thermal expansion of the rotor which has three-dimensional twisted form by accurately grasping temperature distributions in all such cross-sectional planes.

(2) The rotor temperature continuously varies also in the axial direction. Namely, the rotor has temperature distribution also in the axial direction. Practically, there is a temperature differential of 100° to 200° C. between the discharge side and the suction side. In view of such temperature differential, the rotor profile is designed with a certain degree of taper imparted to the profile surface. Practically, this tapered design is achieved merely by axially shifting the profile determined for the discharge end so as to simulate the rotor profile at each axial position with the above-mentioned discharge end profile. Ideally, however, the rotor profile should be determined by assuming numerous axial points over the entire rotor length, grasping the temperature distribution in the cross-section at each of such points, determining an ideal rotor cross-sectional shape for each of the cross-sectional planes, and smoothly connecting such ideal cross-sectional shapes of the numerous axial points. Such a complicated rotor configuration, however, can never be achieved with a known machine such as a hobbing machine or a gear teeth grinder nor by a machine such as a single index cutter having a cutting edge which is shaped to conform with a fixed rotor profile.

(3) Machining error exists not only in the production of rotors but also in the fabrication of the casing. Furthermore, the casing also has different temperature distributions at the suction and discharge sides thereof. Consequently, the distance between the rotor axes is changed during operation to affect the size of the gap between the rotors. It is extremely difficult to estimate the amount of such a change in the rotor gap size.

(4) A gap also exists between each end of the rotor and a bearing supporting the rotor end. The size of this gap also varies during operation, thus forming one of the factors which cause change in the distance between the rotor axes.

(5) In operation of the screw compressor, the gas compressed between rotating rotors causes deflection of the rotors. The deflection is distributed three-dimensionally. Designing the rotor configurations taking into account such rotor deflection is a highly complicated work and cannot easily be carried out.

(6) There are also other factors which affect the size of the gap between the rotors, such as difference in dimensions between individual screw compressors incurred in the course of production, variation in the operating conditions, and so forth. Thus, it is extremely difficult to precisely control extremely small size of the gap between the rotors of screw compressors.

SUMMARY OF THE INVENTION

Accordingly, an object of the present invention is to provide an oil-free screw compressor in which the size of the gap between meshing rotors is minimized to improve the compression performance, thereby overcoming the above-described problems of the prior art.

According to one aspect of the present invention, there is provided a method of manufacturing an oil-free screw compressor of the type which includes a rotor casing, male and female rotors both housed in the casing and having spiral profiles meshing each other, bearing means for rotatably supporting the rotors in the rotor casing, driving means for driving one of the rotors, and timing gears through which the rotation of the one rotor is transmitted to the other rotor in a timed relation, the compressor being operable without any cooling oil supplied to the rotors, the method comprising the steps of: preparing a semi-finished metallic female rotor which has a spiral profile, and a semi-finished metallic male rotor which also has a spiral profile, and also preparing the rotor casing, the bearing means, the driving means and the timing gears; forming a metallic coating film containing particles of a grinding material on the surface of one of the semi-finished rotors; mounting the semi-finished rotor having the coating film formed thereon and the other semi-finished rotor in the rotor casing so that the semi-finished rotors are assembled in the rotor casing with a substantially constant spacing held by the bearing means between the axes of the semi-finished rotors; mounting the timing gears on the semi-finished rotors so as to drivingly connect the semi-finished rotors each other; and driving the semi-finished rotors by the driving means while restraining a back lash in the rotating direction by the timing gears and applying a compression load to the semi-finished rotors so that the coating film on the one semi-finished rotor grinds and generates the surface of the other semi-finished rotor, thereby completing profiling of the other rotor and establishing a desired minimum gap between both rotors.

In a preferred form of the first aspect, the method further includes the step of forming, on the surface of the other semi-finished rotor, a coating film selected from the group consisting of a metallic coating film of a soft metal and a non-metallic coating film of a solid lubricant.

It is also preferred that the metallic coating film on the surface of the one semi-finished rotor is formed by electroless nickel plating, and that the grinding material is at least one of silicon carbide and oxidized alumina.

The metallic coating film on the other semi-finished rotor may be formed by electroless nickel plating and the solid lubricant may include particles of at least one of boron nitride, polytetrafluoroethylene and molybdenum disulfide.

In another preferred form of the first aspect, the other semi-finished rotor has a deddendum circle diameter and a first pitch circle diameter less than the deddendum circle diameter, and the one semi-finished rotor has an addendum circle diameter and a second pitch circle diameter greater than the addendum circle diameter of the one semi-finished rotor, whereby relative slip motion takes place over the entire regions of both semi-finished rotors when the semi-finished rotors are rotated in meshing engagement with each other.

According to another aspect of the present invention, there is provided a method of manufacturing an oil-free screw compressor of the type which includes a rotor casing, male and female rotor which have spiral profiles meshing each other, bearing means for rotatably supporting the rotors in the rotor casing, driving means for driving one of the rotors, and timing gears through which the rotation of the one rotor is transmitted to the other rotor in a timed relationship, the compressor being operable without any cooling oil supplied to the rotors, the method comprising the steps of: preparing a semi-finished metallic female rotor which has a spiral profile, and a semi-finished metallic male rotor which also has a spiral profile, and also preparing the rotor casing, the bearing means, the driving means and the timing gears; grinding the surfaces of the semi-finished rotors into predetermined configurations; forming a metallic coating film containing particles of grinding material on the surface of the semi-finished female rotor; forming, on the surface of the semi-finished male rotor, a coating film of a material softer than the metallic coating film on the female rotor; mounting the thus coated rotors on the bearing means so that the rotors are assembled in the rotor casing with a substantially constant spacing between the axes of the semi-finished rotors; mounting the timing gears on the rotors so as to drivingly connect the rotors each other; and driving the rotors by the driving means while restraining a back lash in the rotating direction by means of the timing gears and applying a compression load to the rotors so that the coating film on the female rotor grinds and generates the coating film on the surface of the male rotor, thereby completing profiling of the male rotor while establishing a desired minimum gap between both rotors.

Preferably, the rotors are thermally expanded as a result of the temperature rise in the compressor operated under the compression load and relative slip is caused to occur between the surfaces of the expanded rotors, thereby effecting the generation of the surface of the male rotor, the generating operation being continued until the temperature of the rotors reaches a level which is higher by a predetermined margin than a maximum design temperature which can be reached by the rotors during normal operation of the compressor, the loaded operation being then ceased to allow the rotors to cool down to the normal temperature.

It is also preferred that the thermal expansion of the female rotor brings the surface of the female rotor into contact with the inner surface of the rotor casing so as to grind also the inner surface of the rotor casing, thus establishing a desired minimum gap between the female rotor and the inner surface of the rotor casing.

As will be understood from the foregoing description, the method of the present invention features the following steps. The one and the other semi-finished rotors having respective coating films are mounted on the bearings means so that these semi-finished rotors are mounted in the rotor casing such that a substantially constant distance is maintained between the axes of the semi-finished rotors. Timing gears are attached to the semi-finished rotors so as to drivingly connect these semi-finished rotors each other. The rotors are driven under a compression load by the driving means such that the back lash in the rotating direction is restrained by the timing gears. Consequently, the coating film of one of the semi-finished rotors grinds and generates the surface of the other semi-finished rotor, thus completing the profiling of the other rotor and establishing a desired minimum gap between the rotors.

Thus, according to the present invention, a pair of rotors, which are major component parts of the screw compressor, are prepared separately from each other and are assembled together with other components. The semi-finished rotors are then subjected to a loaded operation while being drivingly connected each other through the timing gears, so that the coating film on the surface of one of the semi-finished rotors grinds and generates the surface of the other semi-finished rotor. The desired minimum gap between the rotors is established simultaneously with the completion of this generating operation, thus accomplishing the production of the screw compressor.

According to the present invention, therefore, it is possible to simultaneously and accurately effect the determination of the rotor profiles, processing of the rotors and establishment of the minimum rotor gap which could never be achieved by the conventional processes which rely upon computation. It is thus possible to produce an oil-free screw compressor in which the leak through the gap between the rotors is minimized so as to improve the compression performance.

According to a further aspect of the invention, there is provided an oil-free screw compressor manufactured by the method provided by any of the aspects of the invention pointed out above.

The above and other objects, features and advantages of the present invention will become more apparent from the following description of the preferred embodiments.

DESCRIPTION OF THE PREFERRED EMBODIMENTS

Figure 1:
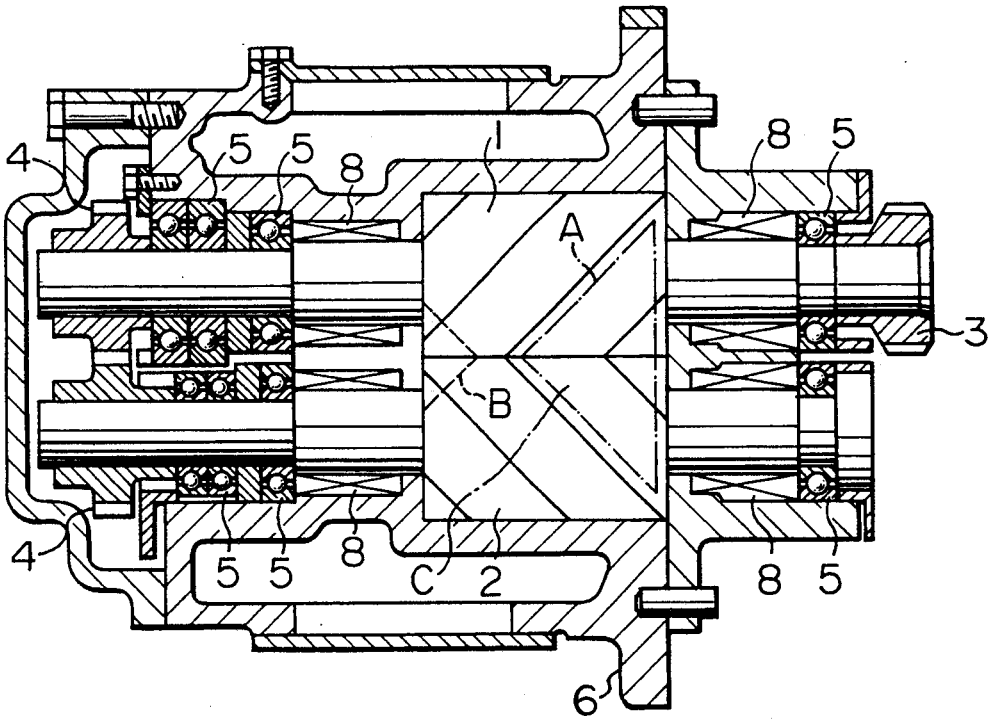
FIG. 1 is an axial sectional view of a screw compressor manufactured by the method of the present invention.

Referring to FIG. 1, an oil-free screw compressor has a rotor casing 6 Which accommodates a female rotor 1 and a male rotor 2 meshing with the female rotor. The rotors 1 and 2 are rotatably supported at their both ends by bearings 5 secured to the rotor casing 6. A shaft seal 8 is associated with each bearing 5 so as to prevent the lubricating oil in the bearing from flowing into a compression chamber C which is defined by the rotor casing 6 and the two rotors 1 and 2. This compressor does not have any means for injecting a fluid such as an oil into the compression chamber C for the purpose of cooling the rotors 1 and 2. The female rotor 1 is provided with a drive pinion 3 fixed to one end thereof. A timing gear 4, fixed to the other end of the rotor 1 meshes with a timing gear 4 fixed to an adjacent end of the male rotor 2. Therefore, when the drive pinion 3 is driven, the pair of rotors 1 and 2 rotate in synchronization with each other due to meshing engagement between the two timing gears 4. Consequently, air is suctioned through a suction port A shown by one-dot-and-dash line and is compressed and discharged through a discharge port B which is shown by chain line. During the operation, since no cooling oil is supplied to the nip between the meshing rotors 1 and 2, the surfaces of the rotors are in contact with air of high temperature and, thus, heated by the air, so that the rotors are thermally expanded to cause deformation of the rotor profiles.

According to the present invention, the profiles of the pair of rotors 1 and 2 as well as the size of the gap between these rotors are formed and determined in the following manner.

Figure 2:
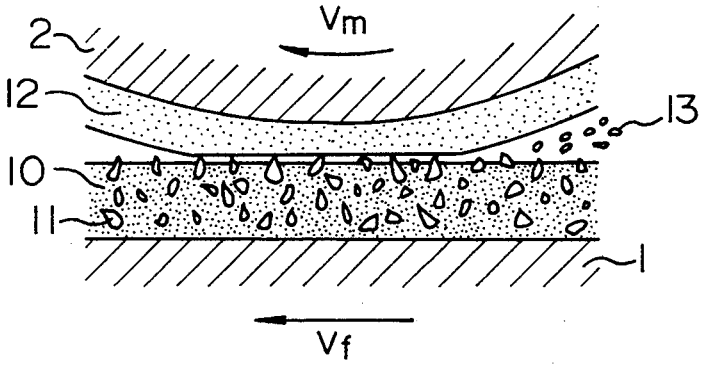
FIG. 2 is a fragmentary schematic enlarged sectional view of surfaces of a pair of rotors of a screw compressor produced by a first embodiment of the method of the present invention.

Referring to FIG. 2 which is a fragmentary enlarged sectional view of the rotors 1 and 2 prepared by the method of the present invention, the female rotor 1 is formed by preparing a blank made of a material having high strength, e.g., a carbon steel or a stainless steel. Fabrication of the other rotor, i.e., male rotor 2, employs a blank made of the same type of material as that of the female rotor 1.

Then, hot rotor profiles are determined for both rotors 1 and 2, based on the amounts of thermal expansion which will be exhibited by the rotors 1 and 2 when they are heated to a predetermined maximum set temperature, as well as on the size of the gap between the rotors after such expansion.

Subsequently, cold rotor profiles which will be exhibited by the rotors when the rotors having the above-mentioned hot roller profiles are cooled down to the normal temperature are determined by computation.

Then, the rotors 1 and 2 are worked by machining such as grinding in conformity with the cold rotor profiles.

The rotor profile of the male rotor 2 may be one that is generated by the profile of the female rotor 1 when both rotors are assembled together in the rotor casing 6 and synchronously operated under a load, as will be described. Thus, the requirement for precision of rotor profile of the male rotor is not so strict as that of the known screw compressor. The rotors 1 and 2 are so profiled that a gap of a size, e.g., 10 to 20 $\mu$m, less than a predetermined gap size, is formed between the rotors 1 and 2 when these rotors are mounted in the rotor housing 6.

The machined female rotor 1 is then coated with a film 10 formed by electroless plating of nickel which enables the film to be formed with a high degree of uniformity in thickness and high level of hardness. During the plating, particles 11 of a material having an extremely high level of hardness, such as silicon carbide or oxidized alumina, are dispersed in the plating material, so that these particles exist in the film 10.

A coating film 12, which is made of a material softer than that of the coating film 10 on the female rotor 1, is formed on the machined male rotor 2. The coating film 12 is formed by effecting electroless plating as in the case of the coating film 10 on the female rotor 1 and, then, softened by a heat treatment. Alternatively, the coating film 12 is formed by plating with a soft metal such as copper.

The rotors 1 and 2 thus plated are assembled in the rotor housing 6 together with the bearings 5 and the shaft seals 8. The rotors are then rotated at different speed Vf and Vm while the back lash in the rotating directions is restricted by the timing gears 4. The discharge port is maintained in an open condition in the beginning period of the rotor operation so as not to apply any load. After a predetermined period of the unloaded operation, a load is applied to progressively increase the discharge pressure. Consequently, the female rotor 1 is heated by the heat of the compressed air and a slip occurs between the surfaces of the pair of rotors 1 and 2 due to relative velocity appearing therebetween. Consequently, the coating film 12 on the male rotor 2 is progressively ground throughout, from the leading to the trailing sides of the rotor profile, by the hard coating film 10 of the female rotor 1. The female rotor 1 also contacts the inner surface of the rotor casing 6 so that the portions of the casing inner surface contacted by the female rotor 1 is ground by the coating film 10 on the female rotor 1.

Thus, the rotors 1 and 2 are deformed as a result of thermal expansion caused by the rise of the temperature of the air to be discharged and also by the rise of the pressure of the air. The deformation of the rotors 1 and 2 and the generating process performed by the female rotor 1 for generating the profile of the male rotor 2 continue until the rotor temperatures reach a level which is higher by a predetermined margin than a predetermined maximum temperature of the pair of rotors 1 and 2 which is substantially equal to the highest rotor temperature reached during ordinary compressing operation, and until such optimum rotor profiles are obtained over the entire rotor surfaces and over entire axial length of the rotor that enable the rotors 1 and 2 to operate with minimal gap preserved therebetween. Formation of the rotor profiles by generation process is thus completed. The compressor is then stopped to allow the rotors 1 and 2 to cool down to the normal temperature.

As will be understood from the foregoing description, in the first embodiment of FIGS. 1 and 2 invention, a pair of rotors 1 and 2, which have been formed separately, are assembled in the rotor housing of the compressor and are rotated under such conditions that a predetermined distance is preserved between the axes of the rotors by the bearings and that the back lash in the rotating directions is restrained by the timing gears, whereby the rotor profile of the male rotor is formed by generating by the female rotor in such a manner as to minimize the size of the gap between the rotors. According to this method, it is possible to more easily and accurately profile the rotors while minimizing the size of the gap formed between the rotors, than in the known method in which profiles of both rotors and the rotor gap size are accurately determined by computation assuming conditions of loaded operation of an imaginary machine and the profiles of both rotors are independently worked by generating operation based on the results of the computation. In addition, the described embodiment enables generation of optimum gaps which well match precisions of the components of the individual compressors.

Figure 3:
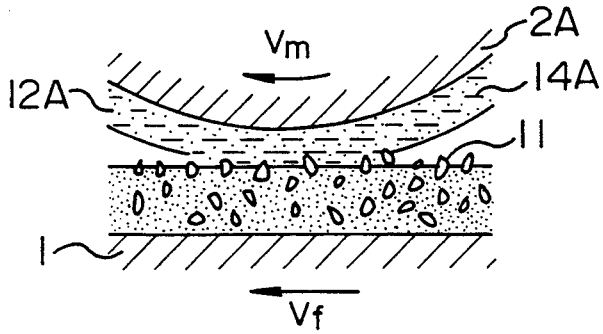
FIG. 3 is a view similar to that in FIG. 2, showing the sectional structures of a pair of rotors of a screw compressor manufactured by a second embodiment of the method of the present invention.

In the second embodiment of FIG. 3, particles 4A of a low-friction material such as boron nitride, polytetrafluoroethylene or molybdenum disulfide are dispersed in a coating film 12A which is formed by electroless nickel plating on the surface of a male rotor 2A. In this embodiment, the generating process for generating the profile of the male rotor 2A by contact with the female rotor 1 is conducted in two stages. In the first stage, the male rotor 2A is contacted by the female rotor 1 only slightly, so that the surface of the male rotor 2A is not generation-processed although the particles 14A of low-friction material on the male rotor surface are ground by shearing. In the second stage, the female rotor 1 strongly contacts with the male rotor 2A so that the hard particles 11 on the female rotor 1 grind only such portions of the soft plating layer 12A on the male rotor 2A that are to be removed. This method eliminates the undesirable phenomena such as biting or seizure between the female rotor 1 and the inner surface of the rotor housing 6 which usually is made of cast iron, even when a contact has occurred therebetween. More specifically, in the region where interference occurs between the outer surface of the female rotor 1 and the inner surface of the rotor casing 6, the portion of the casing inner surface interfered by the female rotor is ground by the hard particles 11 on the female rotor 1, whereby the inner profile of the rotor casing is formed by generating, without any risk of seizure or biting. The second embodiment shown in FIG. 3 may be modified by substituting a film of a solid lubricant such as molybdenum disulfide for the electroless nickel plating layer 12A. Such a modification offers substantially the same advantage, but the embodiment shown in FIG. 3 is preferred particularly when the screw compressor is required to endure a long use.

Figure 4:
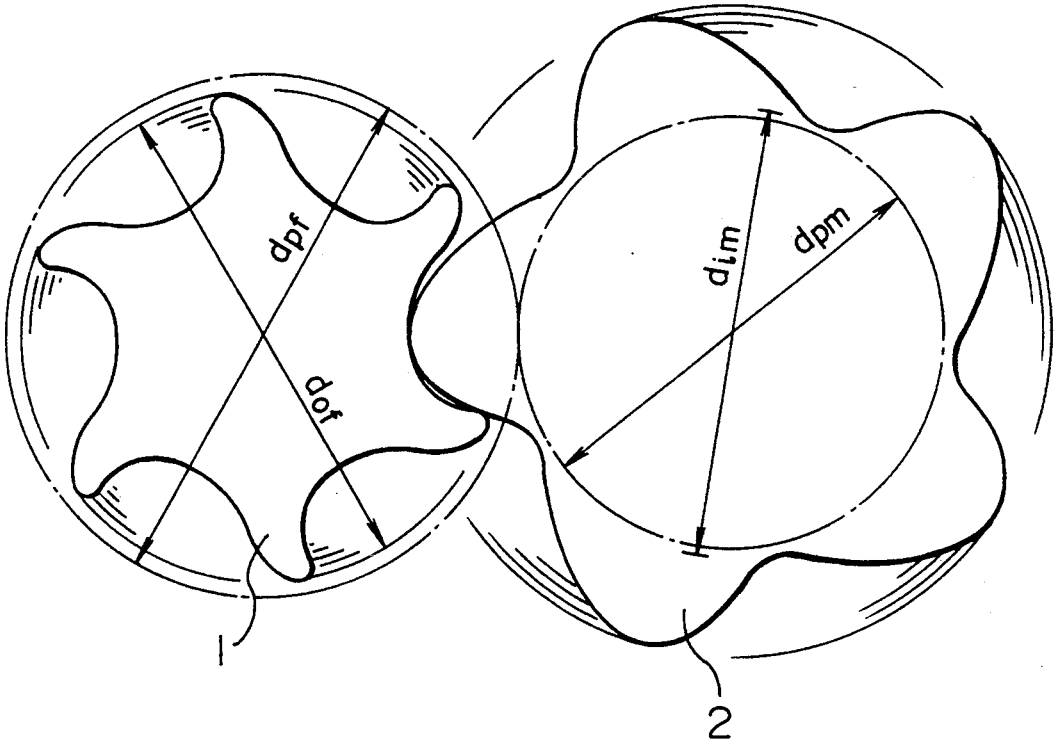
FIG. 4 is an end view of a pair of rotors of a screw compressor manufactured by a third embodiment of the method of the preset invention.
Figure 5:
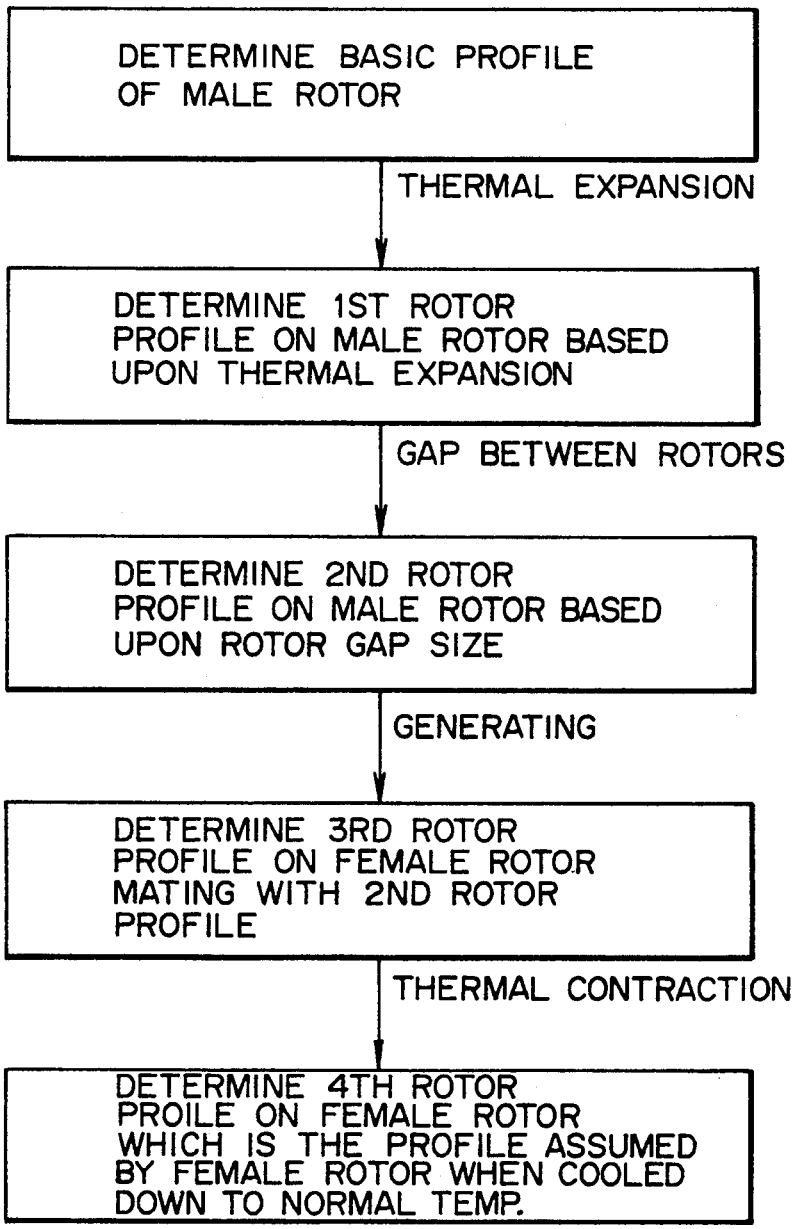
FIG. 5 PRIOR ART
FIG. 5 is a flow chart illustrative of a conventional method of determining profiles of a pair of rotors of a screw compressor.

The third embodiment of FIG. 4 also employs coating films formed on the surfaces of the female rotor 1 and the male rotor 2, as in the first or the second embodiment. Further, the embodiment of FIG. 4 features that, in order to facilitate the generation of the profile of the male rotor 2 effected as a result of contact between two rotors due to thermal expansion, the rolling pitch circle diameter dpm of the male rotor 2 is less than the deddendum circle diameter dim of the same rotor 2 and that the rolling pitch circle diameter dpf of the female rotor 1 is greater than the addendum circle diameter dof of the same rotor 1. According to this feature, no portion of the profiles of the rotors 1 and 2 makes rolling contact during rotation of the meshing rotors 1 and 2. More specifically, since these rotors are rotated at different speeds, relative motion or slip takes place over the entire regions of the profiles of both rotors, so that the surface of the male rotor 2 is finished without fail by generating performed by hard particles 11 (not shown) on the surface of the female rotor 1 when the hard particles 11 contact the surface of the male rotor 2. Improvement in the compression efficiency of an oil-free screw compressor essentially requires that the size of the gap formed between both rotors 1 and 2 is minimized. Actually, however, it is extremely difficult to accurately predict the cross-sectional shape of each rotor in thermally expanded state at each of numerous points assumed along the rotor axis. Therefore, it has been a practical measure to set the size of the gap between the rotors with a certain safety margin, i.e., to a value which is somewhat greater than the predicted gap size, at a cost of reduction in the compression efficiency. In the embodiment of FIG. 4, however, the portion of the male rotor 2 contacted by the female rotor 1 during rotation is profiled by generating which is effected by the portion of the female rotor 1 contacting the male rotor 2, thereby eliminating risk of biting or seizure which may otherwise occur during the operation of the compressor. Thus, the embodiment of FIG. 4 provides an oil-free screw compressor in which any loss due to leak of compressed air through the gap between the rotors 1, 2 is minimized and which can operate with a high degree of reliability.

As has been described, the method in accordance with the present invention employs the steps of: mounting, in a rotor casing of an oil-free screw compressor having timing gears, a pair of independently formed rotors in such a manner that the pair of rotors are held by bearings with a predetermined spacing between the axes of these rotors; and rotating these rotors in synchronization under a suitable level of compression load while the back lash in the direction of rotations is restrained by the timing gear, so that a coating film formed on one of the rotors and containing a hard grinding material generates the surface of the other rotor, thereby profiling the other rotor while minimizing the distance between these rotors. It is therefore possible to easily and precisely profile the other rotor by generating and to minimize the size of the gap between these rotors, thus contributing to improvement in the performance of the compressor.

The surface of the other rotor is coated with a film of a soft metal or solid lubricant so that the surface of the other rotor can easily be ground and profiled without causing any biting or seizure between these rotors.

In the embodiment of FIG. 4 of the rolling pitch circle diameter of the male rotor 2 is less than the deddendum circle diameter of the same rotor 2 and the rolling pitch circle diameter of the female rotor 1 is greater than the addendum circle diameter of the same rotor 1, so that no portion of the pair of rotors makes rolling contact with the mating rotor when both rotors are rotated in meshing condition. Consequently, when the above-mentioned one of the rotors contacts the coating film of the other rotor, the coating film is ground so that the other rotor is precisely profiled by generating performed by the one rotor.

What is claimed is:

1. A method of manufacturing an oil-free screw compressor which includes a rotor casing, male and female rotors both housed in said casing and having spiral profiles meshing with each other, bearing means for rotatably supporting said rotors in said rotor casing, driving means for driving one of said rotors, and timing gears through which the rotation of said one of said rotors is transmitted to the other of said rotors in a timed relationship, the compressor being operable without any cooling oil supplied to said rotors, said method including the steps of:

preparing a semi-finished metallic female rotor which has a spiral profile, and a semi-finished metallic male rotor which also has a spiral profile, and also preparing said rotor casing, said bearing means, said driving means and said timing gears;

forming a metallic coating film containing particles of a grinding material on a surface of one of said semi-finished rotors;

mounting said semi-finished rotor having said coating film formed thereon and the other semi-finished rotor in said rotor casing so that said semi-finished rotors are assembled in said rotor casing with a substantially constant spacing held by said bearing means between the axes of said semi-finished rotors;

mounting said timing gears on said semi-finished rotors so as to drivingly connect said semi-finished rotors with each other; and driving said semi-finished rotors by said driving means while restraining a back lash in the rotating direction by said timing gears and applying a compression load to said semi-finished rotors so that said coating film on said one semi-finished rotor grinds and generates the surface of the other semi-finished rotor, thereby completing profiling of the other rotor and establishing a desired minimum gap between both rotors, and wherein said other semi-finished rotor has a deddendum circle diameter and a first pitch circle diameter less than said deddendum circle diameter, and said one semi-finished rotor has an addendum circle diameter and a second pitch circle diameter greater than the addendum circle diameter of said one semi-finished rotor, whereby relative slip motion takes place over entire regions of both semi-finished rotors when said semi-finished rotors are rotated in meshing engagement with each other.

2. A method according to claim 1, further including the step of forming, on the surface of said the other semi-finished rotor, a coating film selected from the group consisting of a metallic coating film of a soft metal and a non-metallic coating film of a solid lubricant.

3. A method according to claim 1, further including the step of forming, on the surface of said the other semi-finished rotor, a coating film including a solid lubricant.

4. A method according to claim 1, wherein said metallic coating film on the surface of said one semi-finished rotor is formed by electroless nickel plating, and wherein said grinding material comprises at least one of silicon carbide and oxidized alumina.

5. A method according to claim 2, wherein said coating film on said the other semi-finished rotor is a metallic coating film formed by electroless nickel plating and contains a solid lubricant comprising particles of at least one of boron nitride, polytetrafluoroethylene and molybdenum disulfide, said particles being dispersed in said metallic coating film.

6. A method according to claim 3, wherein said solid lubricant comprises particles of at least one of boron nitride, polytetrafluoroethylene and molybdenum disulfide.

7. A method of manufacturing an oil-free screw compressor which includes a rotor casing, male and female rotors which have spiral profiles meshing with each other, bearing means for rotatably supporting said rotors in said rotor casing, driving means for driving one of said rotors, and timing gears through which the rotation of said one rotor is transmitted to the other rotor in a timed relationship, the compressor being operable without any cooling oil supplied to said rotors, the method comprising the steps of:

preparing a semi-finished metallic female rotor which has a spiral profile, and a semi-finished metallic male rotor which has a spiral profile, and also preparing said rotor casing, said bearing means, said driving means and said timing gears;

machining the surfaces of said semi-finished rotors into predetermined configurations;

forming a metallic coating film containing particles of a grinding material on the surface of said semi-finished female rotor;

forming, on the surface of said semi-finished male rotor, a coating film of a material softer than the metallic coating film on said female rotor;

mounting the thus coated rotors on said bearing means so that said rotors are assembled in said rotor casing with a substantially constant spacing between the axes of said semi-finished rotors;

mounting said timing gears on said rotors so as to drivingly connect said rotors to each other; and driving said rotors by said driving means while restraining a back lash in the rotating direction by said timing gears and applying a compression load to said rotors so that the coating film on said female rotor grinds and generates the coating film on the surface of said male rotor, thereby completing profiling of said male rotor and establishing a desired minimum gap between both rotors, and wherein said semi-finished male rotor has a deddendum circle diameter and a first pitch circle diameter less than said deddendum circle diameter, and said semi-finished female rotor has an addendum circle diameter and a second pitch circle diameter greater than the addendum circle diameter of said semi-finished female rotor, whereby relative slip motion takes place over entire regions of both semi-finished rotors when said semi-finished rotors are rotated in meshing engagement with each other.

8. A method according to claim 7, wherein said rotors are thermally expanded as a result of the temperature rise in said compressor operating under said compression load and a relative slip is caused to occur between the surfaces of the expanded rotors, thereby effecting the generation of the surface of said male rotor, the generating operation being continued until the temperature of said rotors reaches a level which is higher by a predetermined margin than a maximum design temperature which can be reached by said rotors during normal operation of said compressor, the loaded operation being then ceased to allow said rotors to cool down to the normal temperature.

9. A method according to claim 8, wherein the thermal expansion of said female rotor brings the surface of said female rotor into contact with an inner surface of said rotor casing so as to grind also the inner surface of said rotor casing, thus establishing a desired minimum gap between said female rotor and said inner surface of said rotor casing.

10. An oil-free screw compressor comprising:

a rotor casing;

male and female rotors both housed in said rotor casing and having spiral profiles meshing with each other;

bearing means rotatably supporting said rotors in said rotor casing;

driving means for driving one of said rotors;

timing gears mounted on said rotors so that the rotation of said one rotor is transmitted to the other rotor in a timed relationship;

the compressor being of the type that is operated without any lubricating oil supplied to said rotors;

a metallic coating film formed on a peripheral surface of one of said rotors, said metallic coating film containing particles of a grinding material;

the other of said two rotors having an outer peripheral surface generated by said metallic coating film on said one rotor;

said rotors being arranged in said rotor casing such that a desired minimum gap is established between said two rotors, and wherein the other rotor has a deddendum circle diameter and a first pitch circle diameter less than said deddendum circle diameter and said one rotor has an addendum circle diameter and a second pitch circle diameter greater than the addendum circle diameter of said one rotor.

11. An oil-free screw compressor according to claim 10, wherein the other of said two rotors has its outer peripheral surface coated with a film selected from the group consisting of a metallic film of a soft metal and a non-metallic film of a solid lubricant.

12. An oil-free screw compressor according to claim 10, wherein the other of said two rotors has its outer peripheral surface coated with a film including a solid lubricant.

13. An oil-free screw compressor according to claim 1, wherein said grinding material comprises at least one of silicon carbide and oxidized alumina.

14. An oil-free screw compressor according to claim 11, wherein the film on said the other rotor is a metallic film of a soft metal and contains a soft lubricant comprising particles of at least one of boron nitride, polytetrafluoroethylene and molybdenum disulfide, said particles being dispersed in said metallic film.

15. An oil-free screw compressor according to claim 12, wherein said solid lubricant comprises particles of at least one of boron nitride, polytetrafluoroethylene and molybdenum disulfide.

* * * * *